United States Patent [19]

Wolff

[11] 4,164,100

[45] Aug. 14, 1979

[54] DEVICE FOR GRINDING SPIRAL DRILLS

[76] Inventor: Robert Wolff, Im Kiesacker, 5466 Engeln, Fed. Rep. of Germany

[21] Appl. No.: 816,676

[22] Filed: Jul. 18, 1977

[30] Foreign Application Priority Data

Jul. 16, 1976 [DE] Fed. Rep. of Germany ..... 2632034

[51] Int. Cl.[2] ..... B24B 3/30

[52] U.S. Cl. ..... 51/239; 51/219 R

[58] Field of Search ..... 51/219 R, 216 R, 239

[56] References Cited

U.S. PATENT DOCUMENTS

| | | | |
|---|---|---|---|
| 1,052,073 | 2/1913 | Mallory | 51/219 R |
| 2,745,228 | 5/1956 | Nadelin | 51/219 |
| 3,100,956 | 8/1963 | Niquet | 51/219 R |
| 3,393,476 | 7/1968 | York | 51/219 R |
| 3,808,748 | 5/1974 | Gunnerson | 51/219 R |

*Primary Examiner*—Harold D. Whitehead

*Attorney, Agent, or Firm*—Abraham A. Saffitz

[57] ABSTRACT

An auxiliary device for facilitating re-grinding and sharpening of spiral drills used by a home or do-it-yourself amateur in conjunction with a conventional grinding machine mounted on a table and having a rotating grinding wheel or disk exposed on a horizontal shaft. The device comprises a fork-shaped bracket including means for clamping to the table. Grooves are provided in the upper surfaces of the forks for bearings which rest in these grooves and are aligned thereby. The device includes a swiveling part which is loosely held into the grooves to accomodate the drill workpiece which is to be reground. Axle journal members in the bearings provide the swiveling movement of the workpiece.

The swiveling part is provided with a groove between the axle journal members into which the workpiece is inserted and this groove has a clearance below the axis of the axle journals and is directed slantingly toward the grinding surface or path of the grinding disc thereby providing the desired re-grinding angle.

2 Claims, 5 Drawing Figures

DEVICE FOR GRINDING SPIRAL DRILLS

BACKGROUND OF THE INVENTION

1. Field of the Invention

The invention relates to an auxiliary device for facilitating the re-grinding of spiral drills on the generated surface of the grinding disk of a grinding machine disposed on a horizontal shaft, or of a wheel stand with sanding table.

2. Description of the Prior Art

Hitherto, blunted drills were mostly thrown away by (amateurs) "dot-it-yourselfers" since there hardly is any possibility of regrinding the drills with the required precision in case of manual incidence and holding, i.e., to provide them with a correct roof angle and point clearance. It is true that numerous grinding machines are known for this purpose. However, they are too expensive to be used within the scope of a home program since generally in these cases price conditions are to be followed to insure that a re-grinding device not be more expensive than the total price of a few spiral drills. But even the known auxiliary devices or drill sharpening devices for "do-it-yourselfers" are still unsatisfactory in many respects for auxiliary devices such as the holding fork, known through German Utility Patent No. 7 439 613, which may be placed on the grinding wheel shaft and which, besides manual holding, also requires manual guidance of the spiral drill that is to be swivelled up and down during regrinding, require a relatively high degree of dexterity in order to provide the cutting edges of the drill with the precise roof angle and clearance angle.

OBJECT OF THE INVENTION

The invention is based on the object of creating an auxiliary device for the above mentioned purpose at a very reasonable cost which may be attached as an additional device to a grinding machine, especially to a so-called adapter wheel stand for home machine tools and which makes possible a very precise sharpening of used drills with the simplest possible handling.

SUMMARY OF THE INVENTION

For the solution of this task, provision has been made according to the invention that the auxiliary device consists of a forkshaped supporting bracket which can be clamped onto the sanding table, at the prongs of which, directed upwards, mounting grooves for the axles aligned with one another have been provided, and of a swivelling part loosely insertable into the grooves for the mounting of the axles and provided with two axle journals, which swiveling part has a groove for the insertion of the spiral drill that is to be reground. This groove lies between the two axle journals and is aligned in a slanted direction corresponding to the desired clearance. The depth of the groove provides a deeper clearance than the axle journals at the swiveling part and the direction of alignment corresponds to the desired roof angle. Thus, direction is slanting relative to the generated surface of the grinding disk.

The present invention offers a series number of practical advantages for the do-it-yourself or amateur home craftsman. First, the auxiliary device is simple and merely consists of two construction parts which can be produced very reasonably, the costs of which are approximately equal to the costs of spiral drills on the market. Secondly, the supporting bracket which is to be attached to the sanding table precisely determines the position of the swiveling axis of the spiral drill that is to be swung up and down during grinding, while the slantingly directed receiving groove for the spiral drill ensures the correct transverse alignment of the spiral drill corresponding to the roof angle on the swiveling part during the grinding movements. A single manual operation is required. Only a manual, firm holding and swiveling up and down of the spiral drill inserted into the groove of the swiveling part will be demanded of the operator, while the path of movement of the spiral drill during the grinding process is determined solely by the auxiliary device. With the auxiliary device according to the invention, spiral drills can therefore be precisely and reproducibly reground with the simplest manipulation.

The swiveling axis of the swiveling part defined by the grooves for the axle bearing lies in a horizontal plane. Whenever the swiveling axis lies in parallel to the shaft of the grinding disk, then an equal point clearance will be achieved over the entire width of the blade e.g., the (cutting edge). Preferably, provision will be made in accordance with the invention, for the swiveling axis to be inclined slantingly vis-a-vis the shaft of the grinding disk by an acute angle in the direction of the slanting position of the receiving groove for the spiral drill. As a result of this provision, a reinforced point clearance will be achieved in the area of the drill tip.

According to the invention, provision may also be made for the supporting bracket to be developed at its underside as a C-clamp by means of a horizontally directed clamping screw and, on the side opposite the clamping screw, there are provided two hooks reaching behind the edge of the sanding table, these hooks enclosing the grinding disk between them. As a result of these features a very easy operation is assured and a reasonably priced attachment has been created for the supporting bracket.

The swiveling part of the auxiliary attachment preferably fits without clearance in the axial direction against the two prongs of the supporting bracket, which are the annular shoulder surfaces, so that the swiveling part will have a degree of freedom of its movement only in the direction of its swiveling path.

The swiveling part, viewed in a vertical cut through its swiveling axis, is approximately U-shaped, whereby the axle journals are disposed on top on the outsides of the two U-shaped lateral legs and the groove is disposed on the bottom leg of the U. The swiveling part bearing the spiral drill is thus mounted in the manner of a balance or a rocking device, whereby the distance in height between the swiveling axis or the balance axis and the longitudinal axis of the spiral drill inserted into the receiving groove, will determine the measure or degree of the point clearance. In order to regrind even spiral drills of a greatly variable diameter with the present auxiliary device, several exchangeable swiveling parts may be employed so that, in the case of interchangeable parts, the distance in height between the swiveling axis and the bottom of the receiving groove is may be made variable due to the interchanged part. For most of the types of spiral drills customarily used for "do-it-yourselfers", two variable swiveling parts will suffice.

Finally, provision may also be made according to the invention for the supporting bracket and the one or several swiveling parts to be fabricated as one-piece diecast metal parts.

BRIEF DESCRIPTION OF THE DRAWING

The invention will be explained in more detail on the basis of two embodiments shown in the drawing.

FIG. 1 shows a so-called protective grinding pedestal 1 with a grinding disk 3 arranged on a horizontal grinding disk shaft 2 and with a cover 4 for the grinding disk. On the rear side of the grinding pedestal a suitable reception (not shown) for connection of an electrically driven home drilling machine (home machine tool) has been provided. In front of the generated surface 5 of the grinding disk there lies a horizontal grinding table 6 which is clamped down on the housing of the grinding pedestal by a screw 7' via an supporting arm 7, whereby the distance between the grinding table 6 and the generated surface 5 of the grinding disk is adjustable. Grinding pedestals with a grinding table shown in the embodiment and also in modified embodiments are quite customary on the market.

Figure 1:
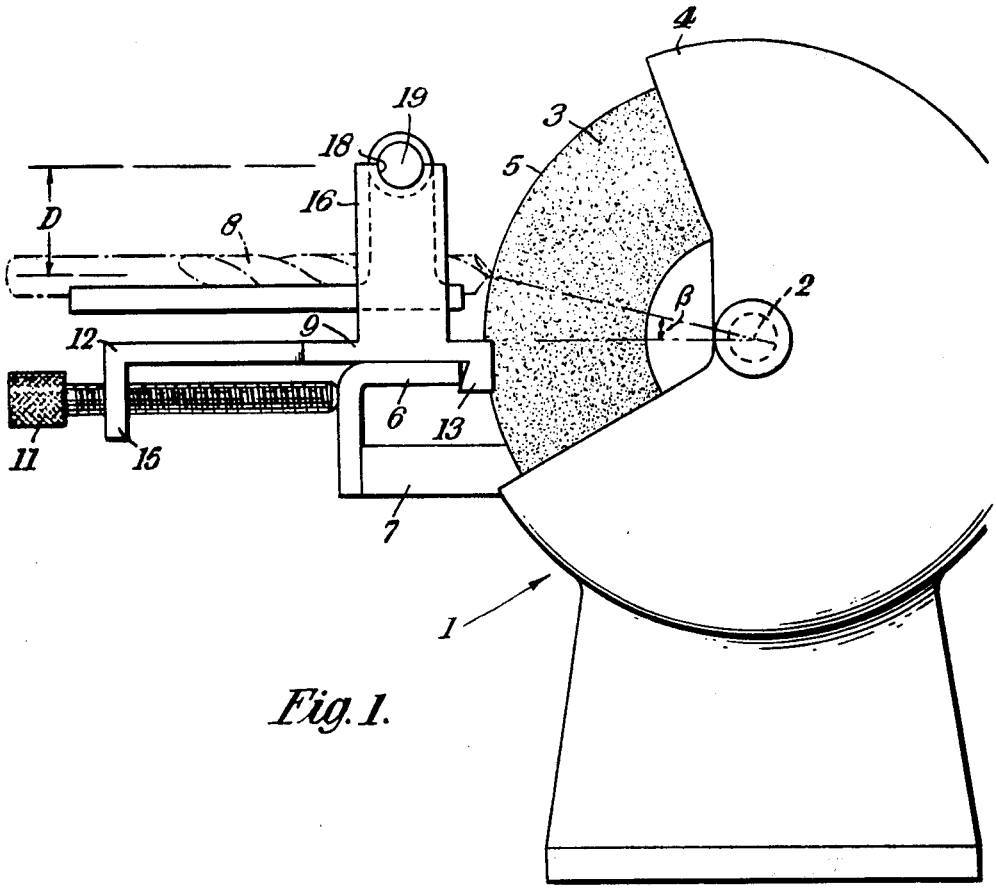
FIG. 1 shows in side view a first embodiment of the auxiliary device according to the invention attached to a wheel stand, with an inserted drill.

The auxiliary device for regrinding of a spiral drill 8 consists of a supporting bracket 9 and a swiveling part 10. The lower part of the supporting bracket 9 has been developed as a C-clamp with horizontally directed clamping down screw 11. The middle leg 12 of the C-clamp rests on the grinding table 6. On the side opposite the clamping down screw 11, two hooks 13, 14 reaching behind the edge of the grinding table 6 and enclosing between them the grinding disk 3, have been molded onto the middle leg 12. The point of the clamping down screw 11 engages with an upwardly angulated part of the supporting arm 7 in relation to which part the guide leg 15 for the clamping down screw 11 has been directed in parallel.

The supporting bracket 9 has two prongs 16, 17 directed upwards at the top front ends of which grooves 18 for the axle journals have been provided. The two prongs 16, 17 together with the middle leg 12 of the supporting bracket form a prong in the grooves 18 for the axle bearings. The swiveling part 10 has been loosely inserted in the manner of a rocking device or balance. The swiveling part 10 (cf. also the perspective presentations for the modified embodiments according to FIGS. 4 and 5)—viewed in a vertical cut through its swiveling axis 19—is approximately U-shaped, whereby on top at the outsides of the U-lateral legs, axle journals 21, 22 have always been molded on, which lie in grooves 18 for the axle bearing. A groove 23 has been molded onto the U-bottom leg of the swiveling part, which (groove) projects only a little piece beyond the bottom leg in the direction of the grinding disk 3, while it stands away with its main length in the back of the U'-bottom leg of the swiveling part. The groove 23, as compared to the plane S of the grinding disk, is inclined by an angle $\alpha$, whereby the angle $\alpha$ determines the roof angle at the point of the drill. The distance in height D between the swiveling axis 19 of the swiveling part and the middle axis of the drill 8 inserted into the groove 23 determines the measure of the point clearance. In order to be able to regrind even drills with a greatly variable diameter with the auxiliary device, advantageously two or more swiveling parts 10 have been assigned to said device, in the case of which the distance in height between the swiveling axis 19 and the bottom of the groove 23 is always dimensioned variably. Since the swiveling parts are inserted loosely into the grooves 18 of the axle bearing of the supporting brackets 9, their replacement (exchange) may be carried out very easily. In the case of the embodiment shown by way of example, the dimensions of the auxiliary device are selected such, that the drill point in the case of a drill 8 according to FIG. 1 held horizontally—is pointed to a point of the grinding disk 3 which lies above the horizontal diametral plane of the grinding disk by an angle $\beta$ of about 15°.

DESCRIPTION OF OPERATION

Figure 2:
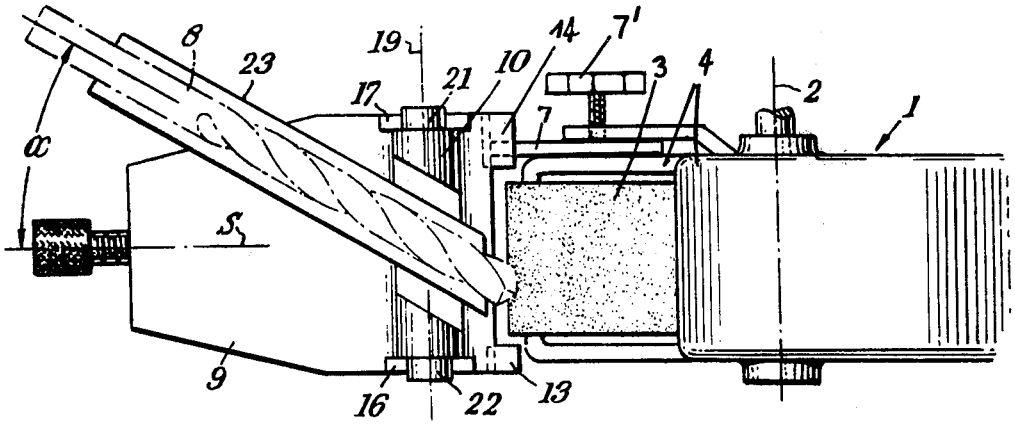
FIG. 2 is a top view of the auxiliary device according to FIG. 1.

The manipulation of the device is as follows:

First of all, the supporting brackets 9 are clamped down on the table 6 by means of the screw 11, whereby the table 6, if needed, is adjusted such that the two hooks 13, 14 will just enclose the grinding disk 3 between them (cf. FIG. 2). Subsequently, the swiveling part 10 is suspended in the grooves 18 for the axle bearings and the spiral drill 8 is inserted into the groove 23 and is pushed at an approximately horizontal alignment with one of its two cutting edges until it is in contact with the generated surface 5 of the grinding disk. Then the swiveling part 10 is swung up and down by hand while holding the spiral drill 8 firmly in the groove 23 until one cutting edge has been reground. Subsequently, the spiral drill with its other edge is placed in contact with the grinding disk which (cutting edge) is reground (re-sharpened) in the same manner by swinging the swiveling part 10.

In the case of the embodiment according to FIGS. 1 and 2, the two prongs 16, 17 or their grooves 18 for the axle bearing are aligned with each other in the direction of the shaft 2 of the grinding disk, so that the swiveling axis 19 defined by the two grooves 18 for the axle bearing, lies in parallel to the shaft 2 of the grinding disk. In the case of this embodiment, the cutting edges of the drill are always given the same point clearance over the full length.

Figure 3:
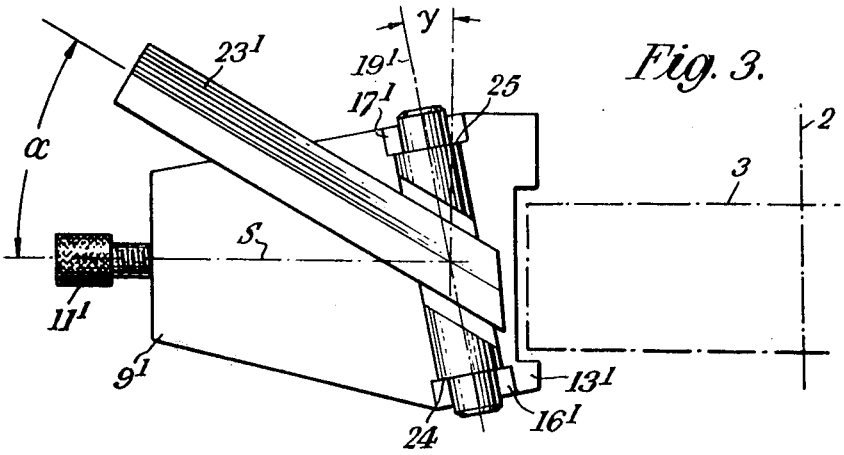
FIG. 3 is a top view of a second embodiment of the auxiliary device with which a reinforced point clearance will be achieved in the area of the drill point.
Figure 4:
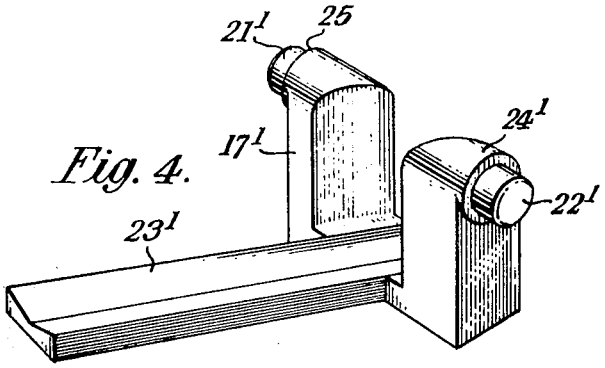
FIG. 4 shows a perspective view of the swiveling part according to FIG. 3.
Figure 5:
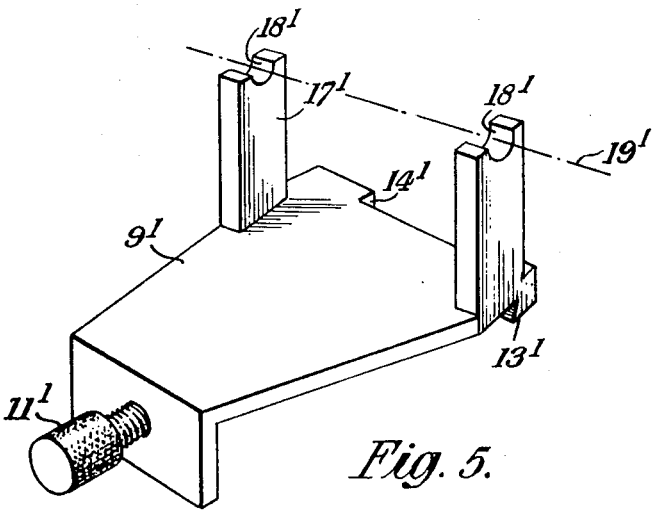
FIG. 5 shows a perspective presentation of the supporting bracket acc. to FIG. 3.

As compared to that in the case of the embodiment according to FIGS. 3 to 5, the prongs 16', 17' of the supporting brackets 9' are displaced in such a way that the swiveling axis 19', defined by their grooves 18' for the axle bearing, is inclined in the direction toward the slanting position of the groove 23' by an acute angle $\alpha$ as compared to the shaft 2 of the grinding disk. In the case of this embodiment, the drill in the area of its point is given a reinforced point clearance. Apart from the variable position of the swiveling axis 19', the embodiment according to FIGS. 3 to 5 is equal to the embodiment according to the FIGS. 1 and 2. Therefore, the same position numbers have been used for the corresponding parts which have merely been provided with a prime. FIG. 4 furthermore clearly shows the annular shoulder surfaces 24, 25 with which the swiveling part 10' fits without clearance against the inner sides of the prongs 16', 17' or 16, 17, of the supporting brackets 9' or 9.

Having thus disclosed, I now claim:

1. An auxiliary device to facilitate re-grinding of spiral drills on the surface of a grinding wheel of a grinding machine having a grinding table adjacent to the wheel comprising:

a supporting bracket having two upwardly directed prong parts which is adapted to be detachably mounted on said grinding table;

fastening means to attach said bracket to said grinding table;

said bracket having supporting grooves in each of said prong parts for bearings;

said two prong parts of said supporting bracket facing each other to serve as aligned supports for axles of a swiveling part journalled in bearings in said prong parts;

said swiveling part having a U-shaped bottom and having attached thereto two wing parts, each of which has a U-shaped portion and an axle bearing, one bearing in each wing part in alignment with the other bearing;

said swiveling part further provided with a pair of axle journals, one in each of said axle bearings, and also provided with an elongated handle part lying below and between said axle journals;

a groove in said elongated handle part of said swiveling part being adapted for holding the drill workpiece to be ground so that the drill resting on the groove lies below said axle journal;

said groove in said handle part being slantingly directed towards the surface of the grinding wheel with the swiveling axis of said swiveling part lying in a horizontal plane;

said swiveling axis of said swiveling part being inclined at a predetermined acute angle to the shaft of the grinding wheel, said acute angle being inclined in the same slanting direction as the axis of said groove in said swiveling part;

said swiveling part being swivelable up and down to precisely align the drill in a resting position on the groove while being reground by the grinding wheel; and a plurality of interchangeable swivelable parts being provided which differ from each other in the distance between the bottom of the receiving grooves and the height of the swiveling axis extending to the mid-point of the grooves in the prongs of the supporting bracket.

2. A device as claimed in claim 1 wherein said swiveling part fits substantially without clearances in an axial direction against the prongs of the supporting brackets and wherein the wing parts of said swiveling part have angular shoulders which rest on the prongs of the supporting bracket.

* * * * *